United States Patent [19]

Salice

[11] 4,430,771

[45] Feb. 14, 1984

[54] HINGE BRACKET-MOUNTING PLATE ASSEMBLY

[75] Inventor: Luciano Salice, Carimate, Italy

[73] Assignee: Deutsche Salice GmbH, Freiberg/Heutingsheim, Fed. Rep. of Germany

[21] Appl. No.: 283,211

[22] Filed: Jul. 14, 1981

[30] Foreign Application Priority Data

| | | | |
|---|---|---|---|
| May 19, 1981 | [EP] | European Pat. Off. | 81 103853.8 |
| Jul. 15, 1980 | [DE] | Fed. Rep. of Germany | 3026796 |
| Oct. 17, 1980 | [DE] | Fed. Rep. of Germany | 3039328 |

[51] Int. Cl.[3] ..... E05D 7/04

[52] U.S. Cl. ..... 16/235; 16/374; 16/382

[58] Field of Search ..... 248/221.3; 16/257, 258, 16/382, 383, 247, DIG. 40, DIG. 39, 245, 246, 235, 374

[56] References Cited

U.S. PATENT DOCUMENTS

| | | | |
|---|---|---|---|
| 3,952,366 | 4/1976 | Rock et al. | 16/235 |
| 4,227,284 | 10/1980 | Zernig | 16/DIG. 39 X |
| 4,366,598 | 1/1983 | Harasaki et al. | 16/382 X |

FOREIGN PATENT DOCUMENTS

| | | | |
|---|---|---|---|
| 341908 | 11/1973 | Austria . | |
| 352577 | 12/1973 | Austria . | |
| 2241942 | 8/1972 | Fed. Rep. of Germany . | |
| 2507850 | 2/1975 | Fed. Rep. of Germany . | |
| 2512656 | 3/1975 | Fed. Rep. of Germany . | |
| 2734017 | 7/1977 | Fed. Rep. of Germany . | |
| 2839576 | 9/1978 | Fed. Rep. of Germany . | |
| 1522807 | 8/1978 | United Kingdom | 16/382 |

*Primary Examiner*—Mark Rosenbaum

*Attorney, Agent, or Firm*—Fleit, Jacobson, Cohn & Price

[57] ABSTRACT

A hinge bracket-mounting plate assembly comprises a detent nose carried at the end of a spring-loaded detent lever and also has a detent opening or detent abutment. When the hinge bracket has been inserted into a track of the mounting plate and pushed along the latter, the detent nose snaps into the detent opening or against the detent abutment to releasably lock the parts together. The extent to which the hinge bracket can be pushed along the mounting plate is limited by a stop, which becomes effective when the detent nose snaps or after it has snapped into the detent opening or against the detent abutment. To eliminate backlash, the detent nose has an engaging side face, which bears on an edge or surface of the detent opening or detent abutment to force a stop carried by the hinge bracket or the mounting plate into backlash-free engagement with a complementary stop carried by the other part.

37 Claims, 57 Drawing Figures

4
11
53
10
51
12
52
13
9
2
21
20
26
57
29
54
3
50
5
59
7
57'
56
60
7
64
25
63
58
61
55
61
62
58

HINGE BRACKET-MOUNTING PLATE ASSEMBLY

BACKGROUND OF THE INVENTION

This invention relates to a hinge bracket-mounting plate assembly wherein one of the parts of the assembly has a detent opening or detent abutment and the other part comprises a spring-loaded detent lever, which at one end carries a detent nose, which snaps into said detent opening or against the detent abutment when the hinge bracket has been inserted into a track of the mounting plate and pushed along said track, and which is adapted to be removed from said opening or abutment, and a stop is provided for limiting the displacement of the parts of the assembly relative to each other as the detent element snaps or after it has snapped into the detent opening or against the detent abutment.

Snap action joints for fixing hinge brackets to mounting plates, e.g., to such plates which have already been mounted on carrying walls, are known in various designs. They permit a quick and simple mounting of furniture parts which have already been provided with hinges. In the usual practice, the hinge brackets are fixed by screws to the associated mounting plates. Whereas this is a simple operation it takes substantial time, e.g., where a door having a plurality of hinges is to be mounted. Besides, the work is rendered more difficult by the fact that the door must usually be held in position as the hinge brackets are fixed by the screws.

This disadvantage can be eliminated by the provision of snap joints between the hinge brackets and the mounting plates.

German Early Disclosure No. 25 12 656 discloses a hinge bracket-mounting plate assembly which is of the kind described first hereinbefore and in which the carrying wall is provided with a sleeve-like receptacle, which constitutes the mounting plate and has tracks for the hinge bracket which is to be inserted. Either the hinge bracket or the sleevelike receptacle has detent openings and the respective other part is provided with spring-loaded detent pins, which fall into the detent openings as the hinge bracket is moved on the track. That known snap action joint for hinge brackets has the disadvantage that a backlash of the detent pins in the detent openings cannot be avoided so that there may be a disturbing backlash between the parts which are connected by the hinges. Besides, it is difficult so to design that known snap action joint that the hinge bracket can be aligned when it has been assembled. Tapered surfaces are provided for depressing the detent pins as the hinge bracket is inserted into the receptacle but said tapered surfaces cannot slidably move over the free ends of the detent pins if the latter protrude beyond the tapered surface. For this reason the detent pins are permitted to protrude from their guiding bores only to such an extent that the free end of the detent pins are engageable by the tapered surface as the hinge bracket is inserted into the receptacle. On the other hand, detent pins protruding only to such an extent may not ensure a reliable fixation of the hinge bracket to the mounting plate when the detent pins have snapped into the detent openings. If the detent pins protrude from the guide bores to a larger extent, it will be necessary to depress the detent pins as the hinge bracket is slidably mounted on the mounting plate so that the tapered surface will engage the free ends of the detent pins. This requirement renders the assembling work more difficult.

German Early Disclosure No. 25 07 850 discloses a hinge bracket which is of the kind described first hereinbefore and provided with a stop, which ensures that the hinge bracket which has been inserted into the track of the mounting plate can easily be moved to the position in which the detent element and detent opening register with each other. That known hinge bracket has also the disadvantage that backlash in the track and between the detent element and the detent opening cannot be avoided.

SUMMARY OF THE INVENTION

It is an object of the invention to provide a hinge bracket-mounting plate assembly which is of the kind described first hereinbefore and has a snap action joint that can easily be made and will be free of backlash in spite of the usual manufacturing tolerances.

This object is accomplished in accordance with the invention in that the detent nose has an engaging side face, which is adapted to bear on an edge or surface of the detent opening or detent abutment in such a manner that the spring-loaded detent lever holds a stop carried by the hinge bracket or mounting plate without backlash against a complementary stop of the other part. As the engaging side face of the spring-loaded detent nose constantly bears on an edge or surface of the detent opening or detent abutment and exerts a lateral force on said edge or surface, the mounting plate and the hinge bracket will be forced against each other so that there can be no backlash between said two parts. The engaging side face of the detent nose obviously must be so designed that it cannot entirely enter the detent opening and that a tapered surface of adequate length is provided for exerting the lateral force.

The distance between the engaging side face of the detent nose and the pivotal axis of the detent lever preferably decreases continously from that portion of said engaging side face which engages said edge or surface of the detent opening or of the detent abutment so that said engaging side face of the detent nose continuously exerts a lateral force on the edge or surface of the detent opening or detent abutment.

According to a further preferred feature of the invention, a clearance-adjusting screw is provided, which is in threaded engagement with the hinge bracket and has an annular groove, which is guided by the edges of a slot in the mounting plate, and said groove has side faces overlapping the edges of said slot. The slot is suitably open at one end so that the groove of the adjusting screw can be inserted into the slot in a simple manner.

The track provided on the mounting plate consists suitably of longitudinal grooves, which are provided on opposite sides of the mounting plate, and the hinge bracket is suitably channel-shaped and has sliding lugs, which are angled inwardly from the ends of the legs of the bracket and adapted to enter said longitudinal grooves.

The stops and counterstops for locating the bracket and plate relative to each other may be constituted by the end faces of the longitudinal grooves and by those faces of the sliding lugs which face the end faces of said grooves.

According to a further preferred feature of the invention, the sliding lugs are guided in the longitudinal grooves in a major part of the length thereof with a backlash and the end portions of the longitudinal grooves are upwardly or downwardly inclined or curved to eliminate said backlash. When the sliding lugs enter the angled or curved end portions of the longitudinal grooves, the straight edges of the sliding lugs will engage the side faces of the longitudinal grooves and the resulting canting will eliminate any backlash.

The detent lever may carry two detent noses disposed on opposite sides of the center line of the hinge bracket.

The screw-guiding slot desirably extend medially in the mounting plate and open at its rear end.

According to a further preferred feature of the invention the detent lever has outwardly protruding teeth, which constitute detent noses, and is pivoted on a transverse pin, which is secured in side walls of the mounting plate, and the detent openings consist of slots formed in the web of the channel-shaped hinge bracket. The compression spring which biases the detent lever may be accommodated in an opening of the mounting plate.

In a desirable embodiment a locking lever having a hook-shaped opening is disposed in an opening of the mounting plate and is pivoted thereto and serves to releasably hold the detent lever in its retracted position and is provided with an outwardly protruding nose, which as the hinge bracket is pushed along the mounting plate is engaged by the hinge bracket and in response thereto turns said locking lever to a position in which the detent lever is released. In this way the mounting plate can be prepared for the application of the hinge bracket.

In another preferred embodiment of the invention, two detent levers are pivoted on a transverse pin, which is secured in the mounting plate, and said detent levers are releasably locked in slot-shaped detent openings formed in the sides of the hinge bracket. The detent levers may consist of two-armed levers and may cooperate like pliers, the transverse pin may be surrounded by a helical torsion spring, the opposite end portions of which bear on the detent levers to hold them in their expanded position, and the rear ends of the detent levers may protrude from the mounting plate. In that case the parts of the assembly can be unlocked in that the rear ends of the detent levers are moved toward each other so that the detent noses will move out of the detent openings.

In another preferred embodiment, the detent lever is pivoted to the hinge bracket on a transverse pin and has projecting teeth, which constitute detent noses extending into detent openings of the mounting plate.

The mounting plate may consist of two parts, one of which is a plate-like member, which is longitudinally adjustable relative to the other for an adjustment of the extent to which the hinge bracket can be pushed along the mounting plate.

In accordance with a further preferred feature of the invention the detent lever is pivoted to the mounting plate and the detent noses consist of two lugs, which are angled from the sides of said lever to form a channel-shaped portion and protrude into guiding grooves provided on the sides of the mounting plate, which lugs extend in said guiding grooves behind the rear edges of the sliding lugs which are carried by the hinge bracket so that said sliding lugs are locked between said detent lugs and the stops consisting of the end faces of the grooves.

In accordance with another preferred feature the detent noses are provided at the ends of the legs of a U-shaped member and said legs are slidably mounted in tracks which are provided on the sides of the mounting plate and cross the longitudinal guiding grooves for the sliding lugs of the hinge bracket, a compression spring is held under initial stress between a web that connects the legs of the U-shaped member and the bottom of a blind bore in the mounting plate, and the detent noses extend outwardly into the longitudinal guiding grooves of the mounting plate and in their locking position extend behind the rear edges of the sliding lugs of the hinge bracket which are guided in said guiding grooves and are thus held between said detent elements and the stops constituted by the end faces of the grooves. The hinge bracket can easily be released from the mounting plate in that the U-shaped member is depressed against the force of the compression spring.

In accordance with another preferred feature, the detent lever is freely pivotally movable in the hinge bracket and has an angled portion which constitutes the detent nose and cooperates with a stop holding the lug in alignment with a guide sleeve of the mounting plate, a slider is slidably mounted in said guide sleeve and adapted to be depressed against the spring force, the detent opening is formed in the wall of the guide sleeve, and when the detent lever has been inserted into the guide sleeve the slider forces the angled portions against an edge of the detent opening so that the stops carried by the hinge bracket are forced against the complementary stops carried by the mounting plate.

According to a further preferred feature of the invention the hinge bracket or the mounting plate or a cover plate thereof is provided with secondary detent openings in that portion thereof which is at the rear when viewed in the direction in which the hinge bracket is pushed onto the mounting plate. As the hinge bracket is pushed onto the mounting plate, the hook-shaped detent noses carried by the detent levers initially snap into said secondary detent openings so that the furniture parts which are to be hingedly connected can be temporarily fixed before the hinge brackets are pushed to their final position, in which the detent noses snap into the primary detent openings to lock the hinge bracket to the mounting plate.

Finally, the detent levers may have extended actuating portions, which may carry locking elements for locking the detent levers in a cocked position so that an inadvertent or unauthorized release of the hinge bracket will be prevented.

Additional features of the invention will become apparent from the following detailed description of the drawings, the drawings themselves and the dependent claims.

BRIEF DESCRIPTION OF THE DRAWINGS

Embodiments of the invention will now be explained more fully with reference to the accompanying drawings, in which.

DESCRIPTION OF THE PREFERRED EMBODIMENTS

FIGS. 1 to 8 show a first embodiment of an assembly comprising a hinge bracket 2 which is releasably locked to a mounting plate 1.

Figure 1:
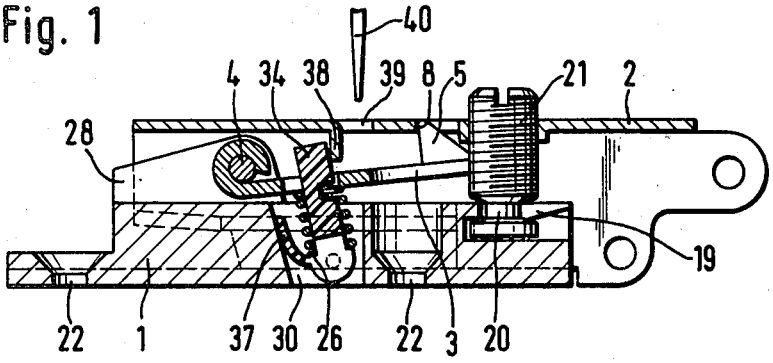
FIG. 1 is a longitudinal sectional view showing a first embodiment of a hinge bracket which has been releasably locked to a mounting plate.
Figure 2:
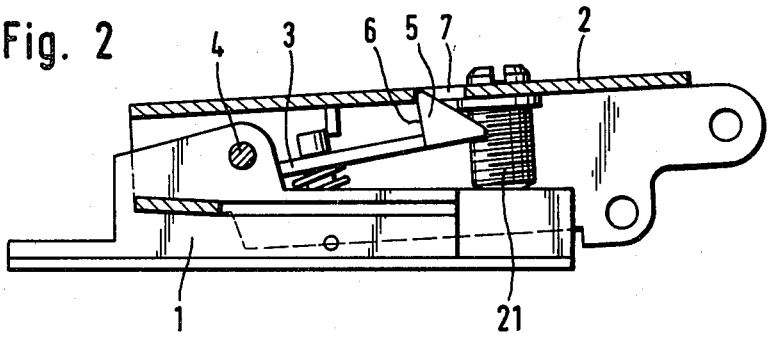
FIG. 2 is a longitudinal sectional view showing the hinge bracket of FIG. 1, which has been releasably locked to a mounting plate in a different angular position, which has been adjusted by an adjusting screw.

A detent lever 3 is pivoted to the mounting plate 1 on a pivot pin 4 and at its forward end carries two detent noses 5, which consist of teeth and on the side facing the pivot pin 4 have engaging side faces 6, which are approximately at right angles to the longitudinal direction of the detent lever 3. When the parts are releasably locked, as is shown in FIGS. 1 and 2, the detent noses 5 extend into detent openings 7 and the upper portion of the engaging side face 6 of each detent nose 5 bears on the edge 8 of the associated detent opening 7.

Figure 8:
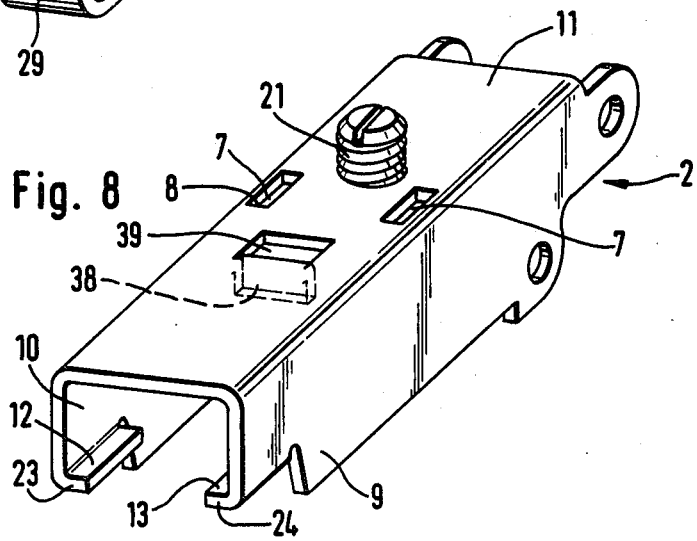
FIG. 8 is a perspective view showing the hinge bracket.
Figure 9:
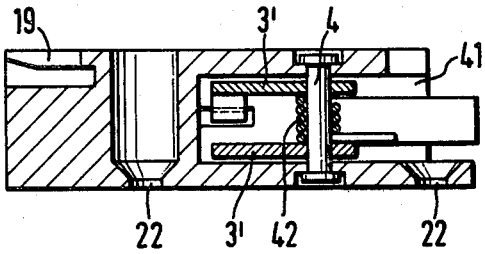
FIG. 9 is a longitudinal sectional view showing a mounting plate according to a second embodiment of the invention.
Figure 10:
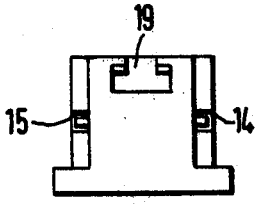
FIG. 10 is a front elevation showing the mounting plate of FIG. 9.
Figure 11:
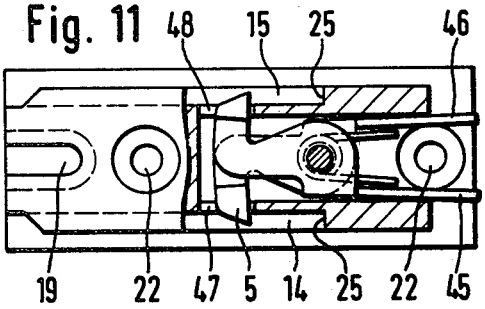
FIG. 11 is a top plan view showing partly in section the mounting plate of FIG. 9.
Figure 12:
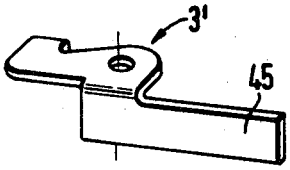
FIG. 12 is a perspective view showing a detent lever.
Figure 13:
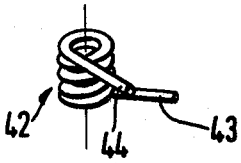
FIG. 13 is a perspective view showing a torsion spring having end legs.
Figure 14:
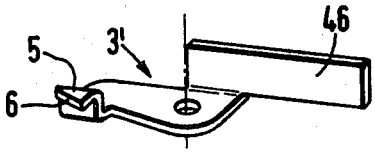
FIG. 14 is a perspective view showing the other detent lever.

It is apparent from FIG. 8 that the hinge bracket 2 is a channel-shaped member comprising flanges 9 and 10, which are connected by the web 11. The forward portion of the hinge bracket 2 is formed with sliding lugs 12, 13, which are angled from the flanges 9, 10 of the bracket.

The mounting plate is formed on both sides with guiding grooves 14, 15, which form a track and serve to receive the sliding lugs 12, 13. As is apparent from FIG. 3, the forward portions 16 of the guiding grooves 14, 15 are slightly upwardly inclined.

The mounting plate 1 has a rear portion 17, which is smaller in width and formed with an opening 18, which is defined by a top wall and by side walls. The top wall is formed with a medially disposed, longitudinal screw-guiding slot 19, which is open at its rear end and serves to guide an annular groove 20 formed in an adjusting screw 21, which has been screwed into a tapped bore formed in the web 11 of the hinge bracket.

The mounting plate 1 is formed with holes 22 for screws serving to secure the mounting plate to a carrying wall.

When it is desired to secure the hinge bracket 2 to the mounting plate 1, the sliding lugs 12, 13, which are relatively short and provided only at the forward end portion of the hinge bracket 2, are inserted into the guiding grooves 14, 15 of the mounting plate 1 until the end faces 23, 24 of the lugs 12, 13 engage stops constituted by the end faces 25 of the guiding grooves 14, 15. As the hinge bracket 2 is advanced in the guiding grooves 14, 15 the annular groove 20 of the adjusting screw 21 enters the screw-guiding slot 19. As soon as the hinge bracket 2 has been advanced in the guiding grooves 14, 15 as far as to the stops 25, the force of the spring 26 causes the detent noses 5 to snap into the detent openings 7 so that the engaging side faces 6 bear on the edge 8 of each detent opening 7. As the distance from the engaging side faces 6 to the pivot pin 4 decreases in the direction toward the detent lever 3, the detent noses 5 tend to force the hinge bracket against the stops 25 so that the hinge bracket and the mounting plate are held together without backlash.

As the forward portion 16 of each guiding groove 14, 15 is inclined, the sliding lugs 23, 24 are canted and slightly deformed in said portions 16 so that any backlash in the guiding grooves will also be eliminated.

The clearance between the parts connected by the hinge can be adjusted in that the adjusting screw 21 is turned to impart a pivotal movement to the hinge bracket 2 relative to the mounting plate 1.

The basic design of the first embodiment of the snap action joint between the hinge bracket 2 and the mounting plate 1 has been described hereinbefore. The same concept is adopted in modified form in the other embodiments. Details of the first embodiment will be explained more in detail hereinafter.

The detent lever 3 consists of a platelike member, which has a curled rear end portion that defines a bearing eye 29. The pivot pin 4 extends through the bearing eye 29 and is secured in outwardly protruding side wall portions 27, 28 of the mounting plate 1. The mounting plate is formed under the detent lever 3 with a medial elongated aperture 30. Those surfaces of the mounting plate which define the sides of the aperture 30 are formed with holes, in which pins 31 of a locking lever 32 are pivotally mounted. The outer end of the locking lever 32 extends into a slot 32' of the detent lever 3. The locking lever 32 is circular in cross-section, except for a flat intermediate portion 33. The slot 32' has the shape of a keyhole (not shown), through which the circular head 34 of the lever 32 can be passed. The intermediate portion 33 of the locking lever 32 is formed with a detent recess 35, which has a height that is as large as the thickness of the detent lever 3. The locking lever 32 extends through the compression spring 26, which bears at one end on inner shoulders of the locking lever 32 and at the other end on the inside surface of the detent lever 3 and urges the detent noses 5 into the detent openings 7 when the hinge bracket has been releasably locked to the mounting plate.

The locking lever 32 is also provided with a resilient tongue 37, which bears on the rear surface of the aperture 30 and urges the locking lever 32 against the forward end of the keyhole slot 32'. As the detent lever 3 is depressed, the recess 35 of the lever 32 snaps over the forward end of the keyhole slot 32' in the detent lever 3 to hold the latter in a cocked position for assembly, shown in FIG. 5.

The hinge bracket 2 has an inwardly protruding tongue 38 that has been struck out from the web 11 and as the hinge bracket is pushed onto the mounting plate strikes against the head 34 of the locking lever 32 to disengage the latter from the detent lever 3. Now the detent elements 5 can snap into the detent openings 7.

The struck-out tongue 38 leaves in the web 11 of the hinge bracket 2 a window 39, through which the bit 40 of a screwdriver can be inserted to depress the detent lever 3 when it is desired to release the hinge bracket 2. When the detent lever 3 has been depressed and the hinge bracket 2 has been pulled out of the guiding grooves of the mounting plate 1, the detent lever 3 is raised until it engages the inside surface of the head 34 of the locking lever 32 at the edges of the slot 32'.

The second embodiment of the snap action joint between a hinge bracket and a mounting plate will now be described with reference to FIGS. 9 to 18, in which corresponding parts are designated by the same reference characters as in FIGS. 1 to 8.

The mounting plate has an aperture 41, which contains a transverse pin 4, on which the detent levers 3, 3' are pivotally mounted. The detent levers 3, 3' are two-armed levers, which are similar to pliers and at their forward ends carry toothlike detent noses 5, which have engaging side faces 6. A helical torsion spring 42 is fitted on the pivot pin 4 and has end legs 43, 44, which bear on the rear lever arms 45, 46 of the detent levers 3, 3' and tend to spread them apart.

The mounting plate is formed on opposite sides with guiding grooves 14, 15 having forward end faces 25, which constitute stops.

The detent noses 5 of the detent levers 3, 3' extend through slots 47, 48 formed in the bottom of respective guiding grooves 14, 15.

The rear end portion of the mounting plate 1 is formed with a screw-guiding slot 19, which is open at the rear and serves to guide the groove 20 of the adjusting and fixing screw 21.

Figure 15:
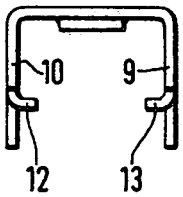
FIG. 15 is a front elevation showing the hinge bracket in accordance with the second embodiment of the invention.
Figure 16:
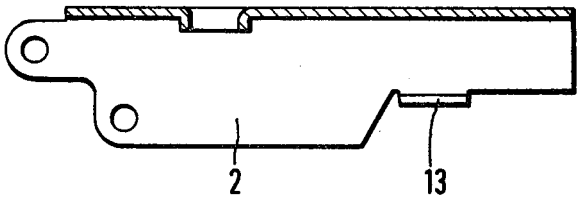
FIG. 16 is a longitudinal sectional view showing the hinge bracket of FIG. 15.

The hinge bracket 2 shown in FIGS. 15 and 16 is channel-shaped and carries sliding lugs 12, 13, which are angled from the flanges 9, 10 of the channel-shaped bracket. When the hinge bracket has been pushed onto the mounting plate, the rear edges of the sliding lugs 12, 13 are adjacent to the slots 47, 48 so that the engaging side faces 6 of the detent noses 5 bear on said rear edges and there is no need for separate detent openings. As is apparent from FIG. 18, the sliding lugs 12, 13 are resiliently gripped between the detent noses 5 and the stops 25.

Figure 17:
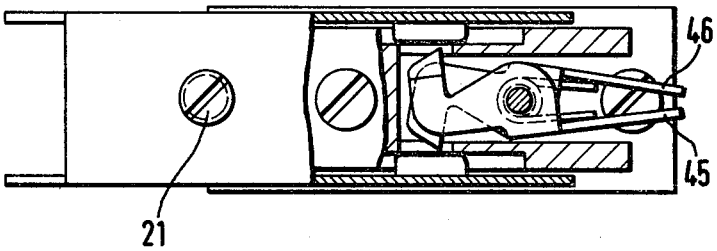
FIG. 17 is a top plan view showing partly in section the second embodiment of the hinge bracket-mounting plate assembly with retracted detent levers.
Figure 18:
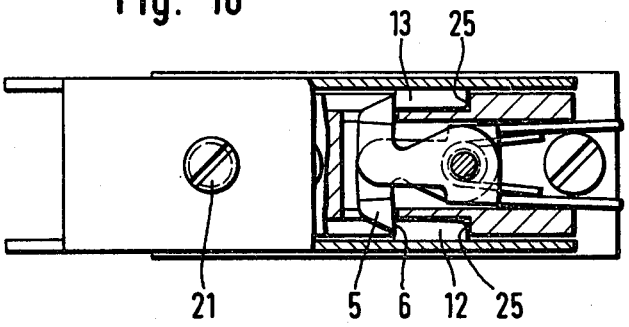
FIG. 18 is a view that is similar to FIG. 17 and shows the hinge bracket releasably locked to the mounting plate, FIGS. 19*a* to 19*h* taken together are an exploded view showing the components of a third embodiment of the hinge bracket-mounting plate assembly.

When it is desired to eliminate the snap action joint, the rear lever arms 45, 46 of the detent lever 3, 3' are compressed as is shown in FIG. 17 so that the hinge bracket 2 can be pulled out of the guiding grooves of the mounting plate 1.

A third embodiment is now explained with reference to FIGS. 19 to 22. The same reference characters are again used for corresponding parts.

The hinge bracket 2 is composed of the components shown in FIGS. 19*a* to *e*. The curled eye 29 of the detent lever 3 is pivoted on the pin 4, which is secured in holes formed in the flanges 9, 10 of the hinge bracket 2. The detent lever 3 is formed on opposite sides with angled lugs 5, which constitute detent noses. At its rear end, the detent lever 4 has an angled extension 50, which protrudes outwardly beyond the web 11 of the hinge bracket so that the detent lever 3 can be turned by hand.

The flanges 9, 10 of the hinge bracket 2 are provided at their rear ends with stops 51, 52, which are engageable by the detent lever 3 so that the latter can be pivotally moved between said stops and the rear edge 53 of the web 11 of the hinge bracket 2.

The compression spring 26 is gripped between a tongue 54, which has been struck out from the detent lever 3, and the inside surface of the web 11 of the hinge bracket 2, and urges the detent lever 3 toward the stops 51, 52.

Figures 19A, 19B, 19C, 19D, 19E, 19F, 19G, 19H:
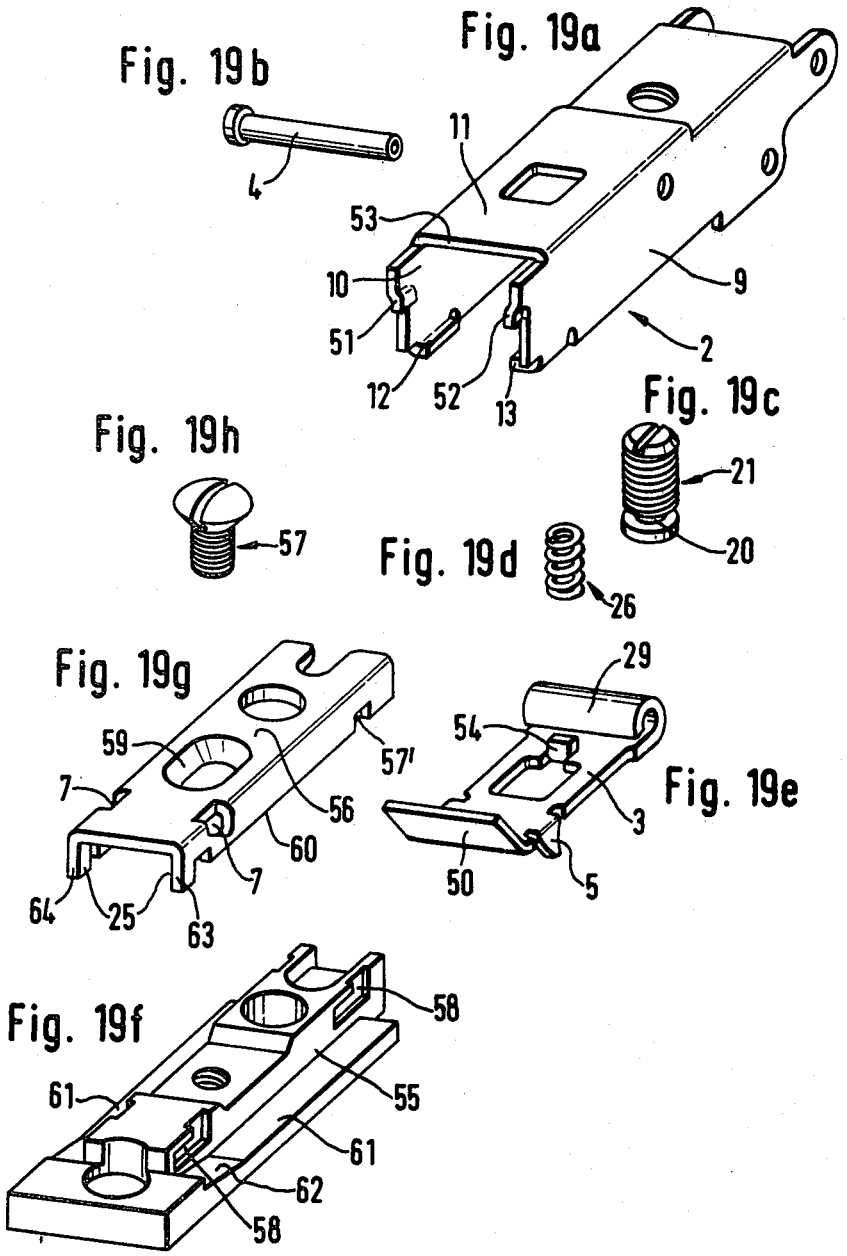
Figure 20:
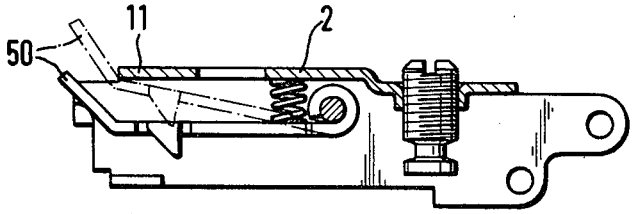
FIG. 20 is a longitudinal sectional view showing the hinge bracket of FIG. 19.
Figure 21:
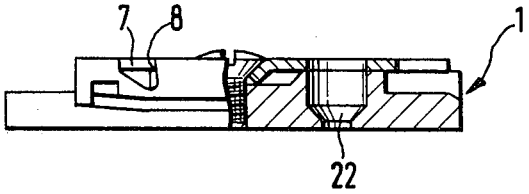
FIG. 21 is a side elevation showing partly in longitudinal section the mounting plate of FIG. 19.

As is apparent from FIGS. 19*f–h*, the mounting plate consists of a baseplate 55 and a cover plate 56, which is secured to the baseplate 55 by a screw 57. The cover plate 56 is channel-shaped and has inwardly directed projections 57', which engage L-shaped grooves 58 of the baseplate 55. The projections 57' are inserted through the outer parts of the L-shaped grooves 58 into the inner parts thereof and can be shifted along the latter to adjust the extent to which the hinge bracket 2 can be pushed along the mounting plate 55, 56. The fixing screw 57 extends through a slot 59 in the cover plate so that the parts 55, 56 can be displaced relative to each other over an adequate length.

The guiding grooves 14, 15 for guiding the sliding lugs 12, 13 of the hinge bracket 2 are defined by the free side edges 60 of the flanges of the cover plate 56 and the flanges 61 of the baseplate 55. Each flange 61 has an angled forward portion 62, which serves to cant the sliding lugs 12, 13 so that backlash is eliminated.

Figure 22:
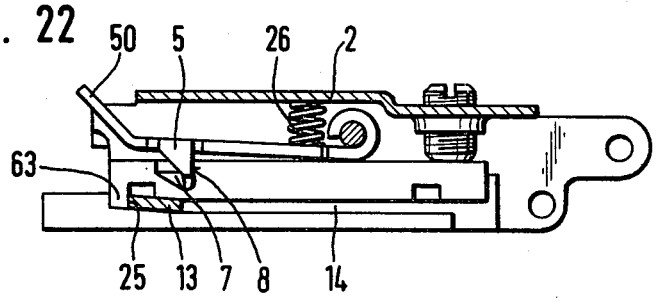
FIG. 22 is a longitudinal sectional view showing the hinge bracket which has been releasably locked to the mounting plate.
Figure 24:
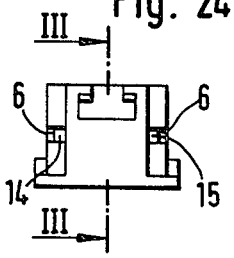
FIG. 24 is a front elevation showing the mounting plate according to FIG. 23.

As the hinge bracket 2 is pushed along the mounting plate in the manner shown in FIG. 22, the detent noses 5 snap into detent openings 8 formed in the cover plate 56.

The cover plate 56 has angled rear end portions 63, 64, which have forward end faces 25 that constitute stops. When the hinge bracket 2 has been inserted into the guiding grooves 14, 15 of the mounting plate, the hinge bracket 2 is resiliently gripped between the stops 25 and the edge 8 of each detent opening 7.

To release the hinge bracket 2 from the mounting plate 1, it is sufficient to raise the rear portion 50 of the detent lever 3 with the thumb so that the snap action joint is eliminated.

Figure 3:
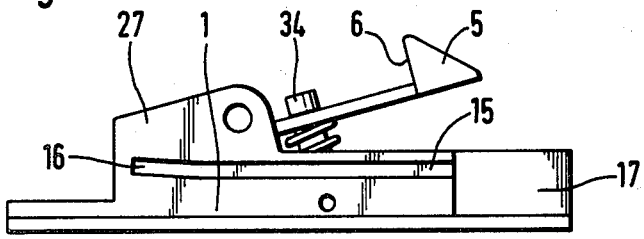
FIG. 3 is a side elevation showing the mounting plate after the hinge bracket has been removed.
Figure 4:
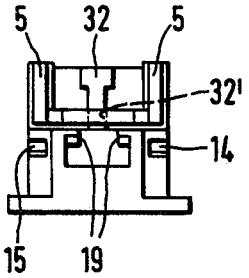
FIG. 4 is a front elevation showing the mounting plate ready to receive the hinge bracket.
Figure 5:
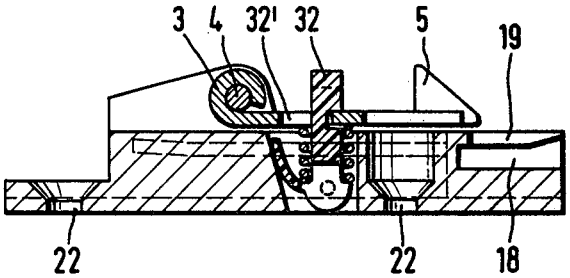
FIG. 5 is a longitundinal sectional view showing the mounting plate.
Figure 6:
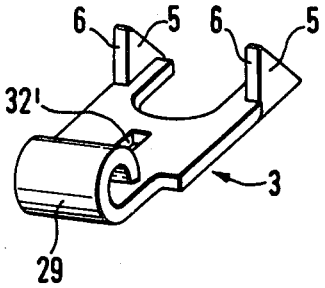
FIG. 6 is a perspective view showing the detent lever.
Figure 7:
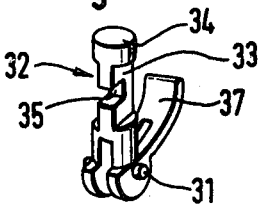
FIG. 7 is a perspective view showing the locking lever for locking the detent lever in a cocked position.
Figure 23:
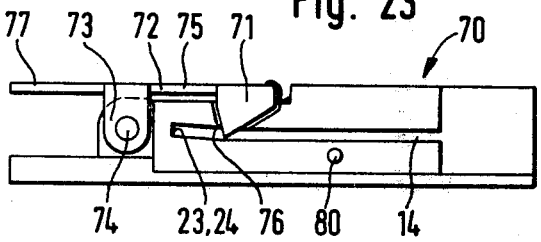
FIG. 23 is a side elevation showing a mounting plate in accordance with another embodiment of the invention.
Figure 26:
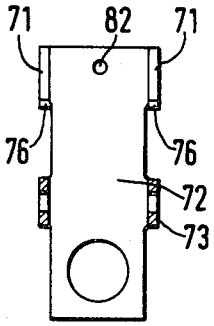
FIG. 26 is a bottom view showing the detent lever which is pivoted to the mounting plate of FIGS. 23 to 25.

The mounting plate 70 shown in FIG. 23 differs from the one shown in FIG. 3 only in that the detent lever 72 is double-armed. The lever 72 consists of a sheet metal stamping and has an intermediate portion formed with angled lugs 73, which have bores, by which the lever is pivoted to the end portions of the pivot pin 74 that is mounted in the mounting plate 70. The detent lever 72 has a channel-shaped forward end portion 75 having flanges which constitute detent noses 71, which have sloping rear edges.

Figure 29:
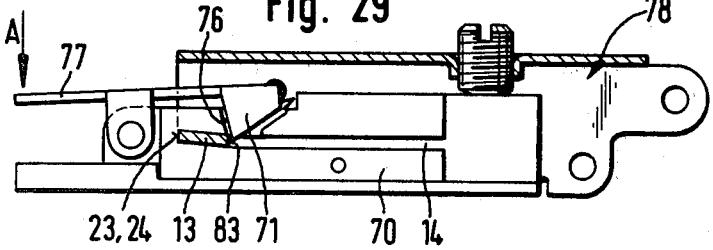
FIG. 29 is a side elevation showing the mounting plate of FIGS. 23 to 25 and a longitudinal sectional view showing the hinge bracket of FIGS. 26 and 27, which is connected to said mounting plate.
Figure 30:
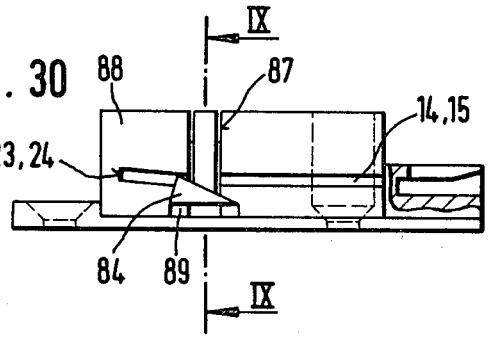
FIG. 30 is a side elevation showing a mounting plate in accordance with another embodiment of the invention.
Figure 31:
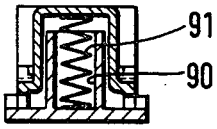
FIG. 31 is a sectional view taken on line IX—IX of FIG. 30.
Figure 32:
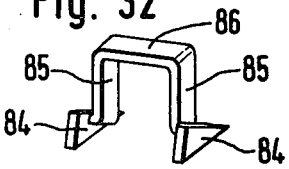
FIG. 32 is a perspective view showing the U-shaped member provided with the detent noses.
Figure 33:
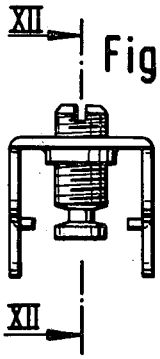
FIG. 33 is a front elevation showing a hinge bracket adapted to be connected to the mounting plate of FIGS. 30 and 31.
Figure 34:
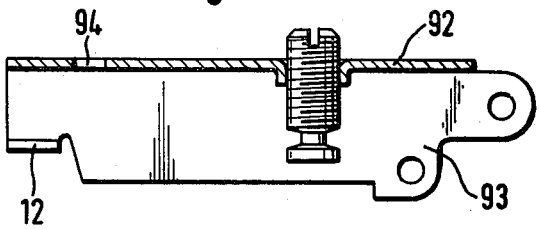
FIG. 34 is a longitudinal sectional view taken on line XII—XII of FIG. 33.

The rear arm 77 of the double-armed lever 72 constitutes a key, which can be depressed in the direction of the arrow A in FIG. 29 to eliminate the snap action joint between the mounting plate 70 and the hinge bracket 78.

Figure 25:
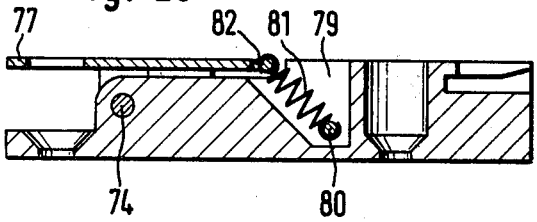
FIG. 25 is a sectional view taken on line III—III of FIG. 24.
Figure 27:
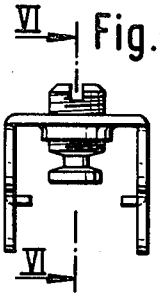
FIG. 27 is a front elevation showing a hinge bracket adapted to be connected to the mounting plate of FIGS. 23 to 25.
Figure 28:
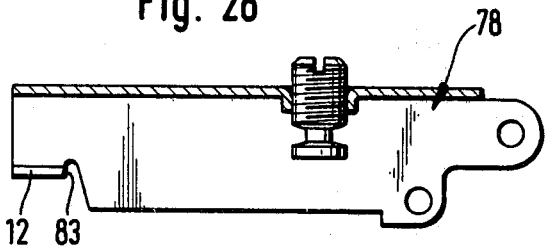
FIG. 28 is a sectional view taken on line VI—VI of FIG. 27.

As is apparent from FIG. 25, the mounting plate 70 is formed in an intermediate portion with an aperture 79. A bolt 80 is secured in the lower portions of the side walls of said aperture 79. One end of a tension spring 81 is secured to the bolt 80. The other end of the spring 81 is hooked into a bore 82 of the arm 75 of the lever 72.

The hinge bracket 78 is substantially similar to the one shown in FIG. 8. Its rear end portion is formed with angled sliding lugs 12, 13, which can be inserted into the guiding grooves 14, 15 of the mounting plate 70.

When the parts are releasably interlocked as shown in FIG. 29, the forward edges 76 of the detent noses consisting of the lugs 71 engage the rear edges 83 of the sliding lugs 12, 13 so that the latter are gripped between the edges 76 and the stops formed by the end faces 23, 24 of the grooves 14, 15.

The embodiment shown in FIGS. 30 to 35 differs from the emmbodiment of FIGS. 23 to 29 essentially only in that the detent noses 84 are carried by the end portions of the legs 85 of a U-shaped member 86. The legs 85 are slidably mounted in the mounting plate 88 in guiding grooves 87, which cross the guiding grooves 14, 15, as is apparent from FIG. 30. As the detent noses 84 extend into apertures 89, which are formed in the mounting plate 88 below the guiding grooves 14, 15, the U-shaped member 86 cannot be withdrawn outwardly unless its legs 85 are spread apart.

The mounting plate 88 has a bore 90, which is disposed below the web which connects the legs 85 of the U-shaped member. The bore 90 contains a compression spring 91, which bears at one end on the bottom of the bore 90 and at the other end on the web which connects the legs of the U-shaped member 86.

Figure 35:
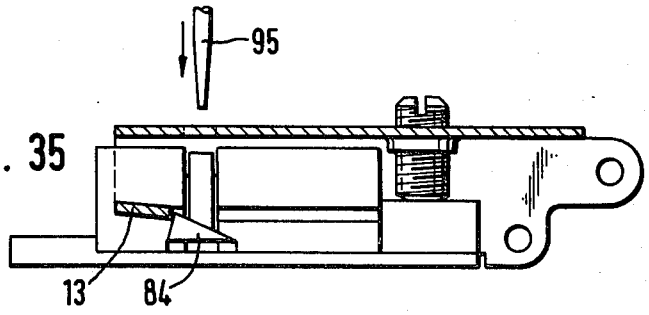
FIG. 35 is a side elevation showing the mounting plate of FIGS. 30 and 31 and the hinge bracket of FIGS. 33 and 34 releasably locked to said mounting plate.
Figure 37:
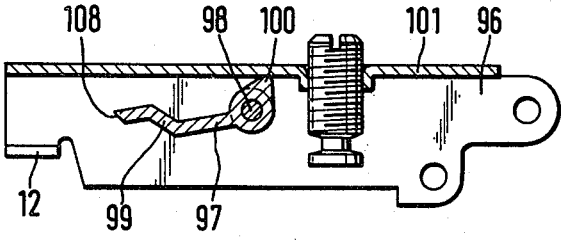
FIG. 37 is a sectional view taken on line XV—XV of FIG. 36.
Figure 36:
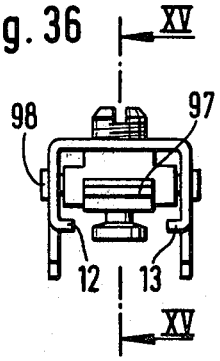
FIG. 36 is a front elevation showing a hinge bracket in accordance with another embodiment of the invention.
Figure 38:
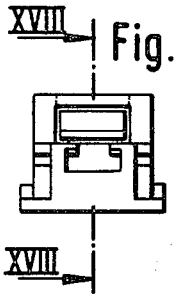
FIG. 38 is a front elevation showing a mounting plate for use with the hinge bracket of FIGS. 36 and 37.
Figure 39:
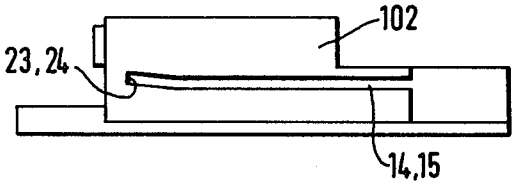
FIG. 39 is side elevation showing the mounting plate of FIG. 38.
Figure 40:
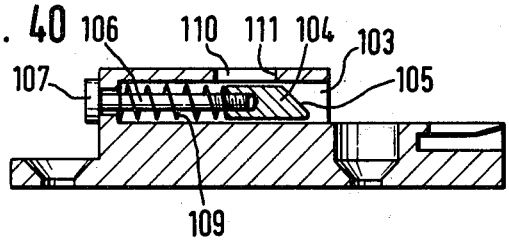
FIG. 40 is a sectional view taken on line XVIII—XVIII of FIG. 38.

The web 92 of the hinge bracket 93 is formed with an opening 94, through which a screwdriver 95 or the like can be inserted to depress the slider 86 in order to eliminate the snap action joint shown in FIG. 35 between the hinge bracket 92 and the mounting plate 88.

In the embodiment shown in FIGS. 36 to 41 the detent nose consists of an angled portion 99 of one arm of the detent lever 97, which is pivoted on a pin 98, which is secured in the hinge bracket 96. Adjacent to the pin 98, the lever 97 has an extension 100, which constitutes a second lever arm and in the manner shown in FIG. 15 bears on the web 101 of the hinge bracket 96 to maintain the lever 97 substantially parallel to the hinge bracket 96.

The mounting plate 102 has a longitudinal guide sleeve 103, in which a slider 104 is guided. The slider 104 has a beveled forward end face 105. A rod 106 secured to the rear end of the slider 104 and extending through the end wall of the guide sleeve 103 has a free end portion carrying a head 107.

Figure 41:
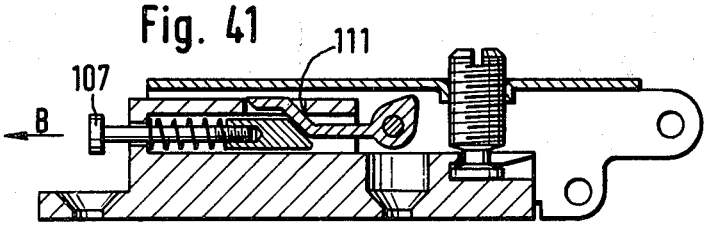
FIG. 41 is a sectional view showing the hinge bracket of FIGS. 36 and 37 releasably locked to the mounting plate of FIGS. 38 to 40.

As the sliding lugs 12, 13 of the hinge bracket are inserted into the longitudinal guiding grooves 14, 15 of the mounting plate 102, the beveled end face 108 engages the beveled forward end face 105 of the slider so that the latter is depressed in the guide sleeve 103 against the force of the compression spring 109. The top wall of the guide sleeve 103 is formed with a window 110. As soon as the lever 97 has pushed back the slider 104 beyond the window 110, the angled forward end portion of the lever 97 snaps into the window 110 so that the slider 104 forces the sloping portion 99 of the lever 97 against the forward edge 111 of the window 110, as is shown in FIG. 41. As the slider 104 tends to raise the lever 97 and to hold the sloping portion 99 of the lever 97 against the edge 111 of the window 110, the forward edges of the sliding lugs 12, 13 of the hinge bracket 96 are forced against the stops constituted by the end faces of the guiding grooves 14, 15. In this way the hinge bracket 96 is held on the mounting plate 102 without backlash.

The hinge bracket 96 can be released from the mounting plate 102 in that the head 107 of the rod 106 is pulled in the direction of the arrow B.

In the hinge bracket shown in FIGS. 42 and 44 to 46 a locking member 112 has been frictionally fitted on the extended actuating portion 50 of the detent lever 3. As is apparent from FIG. 46, the actuating portion 50 of the detent lever 3 is bifurcated. The locking member 112 is best apparent from FIG. 45 and is formed on opposite sides with grooves 113 for guiding the prongs of the bifurcated actuating portion 50 so that the locking member 112 can be slidably mounted on said actuating portion. The locking member 112 is provided at its forward end with beveled surfaces 114, 115, which merge at a bend line and include an obtuse angle with each other.

Figure 42:
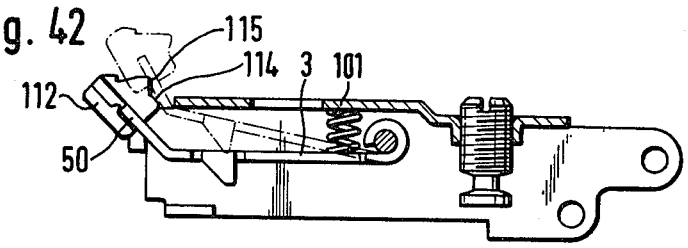
FIG. 42 is a longitudinal sectional view showing a hinge bracket in which a locking member has been partly fitted on a detent lever pivoted to the hinge bracket.
Figure 43:
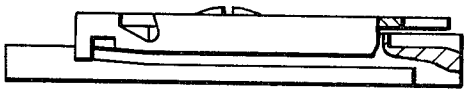
FIG. 43 is a side elevation showing a cover plate, which has been pushed onto the body of a mounting plate and serves to releasably lock the hinge bracket of FIG. 42.

FIG. 42 shows the hinge bracket 2 before it is mounted on the mounting plate 55, 56 shown in FIG. 43. In this state, the locking member 112 has been pushed onto the actuating portion 50 only to such an extent that the locking member 112 does not lock the detent lever 3. When the hinge bracket 2 has been pushed onto the mounting plate 55, 56, the locking member 112 is forcibly pushed down along the actuating portion 50 until the rear edge of the web 11 of the hinge bracket 2 engages the locking member 112 at the bend line between the beveled surfaces 114, 115 to hold the detent lever 3 in locking position.

Figure 44:
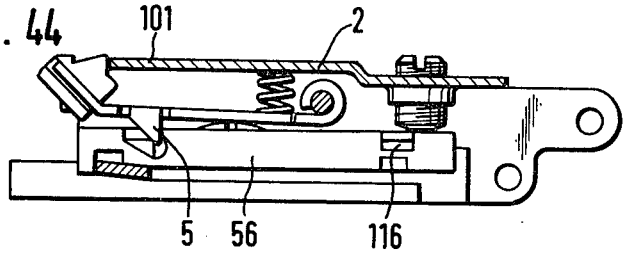
FIG. 44 is a longitudinal sectional view showing the hinge bracket of FIG. 42, which has been releasably locked to the cover plate of FIG. 43 and shows how the locking member locks the detent lever in its locking position.
Figure 45:
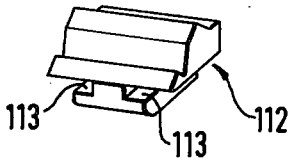
FIG. 45 is a perspective view showing the locking member of FIGS. 42 to 44.
Figure 46:
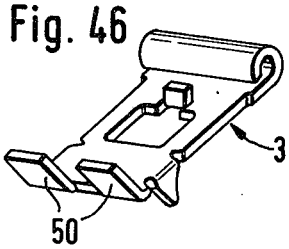
FIG. 46 is a perspective view showing the detent lever of FIGS. 42 to 44.

As is apparent from FIG. 44, the rear portion of the cover plate 56 is formed on opposite sides with secondary detent openings 116. When the hinge bracket 2 has been pushed onto the cover plate 56 to a short extent, the hook-like detent noses 5 of the detent lever 3 snap into said detent openings 116 so that the hinge bracket 2 will be held in this position until it is completely pushed onto the mounting plate 1.

Figure 47:
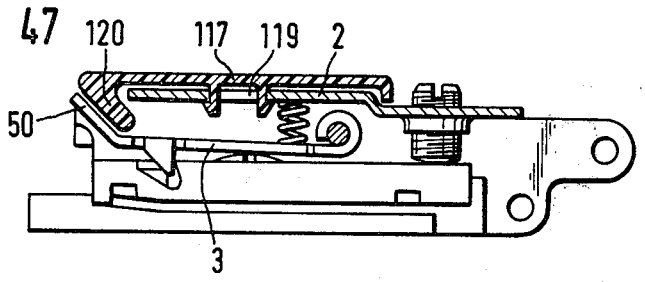
FIG. 47 is a view similar to FIG. 44 and shows a mounting bracket which is releasably locked to the mounting plate and provided with a different locking member.
Figure 48:
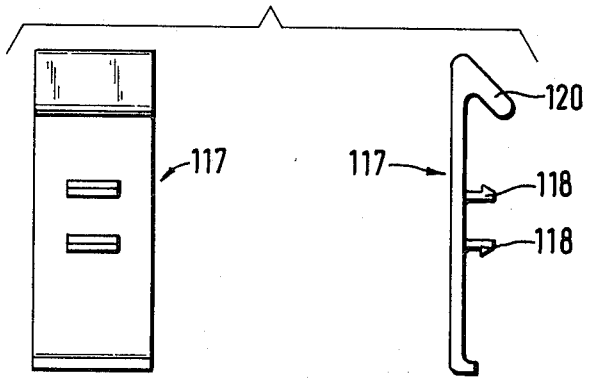
FIG. 48 is a side elevation and bottom view showing the locking member of FIG. 47.

The locking member 117 shown in FIGS. 47 and 48 consists of a flat bar, which is formed with detent hooks 118 and disposed in an aperture 119 of the hinge bracket 2 and secured to the latter. The locking member 117 has at its forward end a hook-shaped sloping portion 120, which bears on the actuating portion 50 of the detent lever 3.

Figure 49:
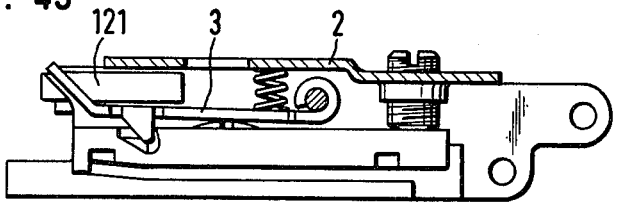
FIG. 49 is a view which is similar to FIG. 44 and shows the hinge bracket which is releasably locked to the mounting plate and provided with a third embodiment of the locking member.
Figure 50:
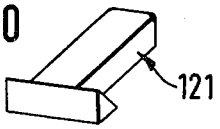
FIG. 50 is a prespective view showing the locking member of FIG. 49.

The embodiment shown in FIGS. 49 and 50 comprises a locking member 121, which has been frictionally fitted between the detent lever 3 and the hinge bracket 2 after the latter has been entirely pushed onto the mounting plate 1.

The locking members consist suitably of a sufficiently elastic plastic material.

What is claimed is:

1. A hinge bracket-mounting plate assembly comprising:

a hinge bracket;

a mounting plate having an elongated track;

one of said hinge bracket and said mounting plate having a detent opening including a detent abutment and the other of said hinge bracket and said mounting plate having a spring-loaded detent lever including a detent nose at one end thereof, said detent lever engageable with said detent abutment when the hinge bracket has been inserted into said track of the mounting plate and pushed along said track, and adapted to be removed from said abutment;

stop means for limiting the displacement of said hinge bracket and said mounting plate relative to each other as the detent lever engages the detent abutment;

said detent nose including an engaging side face adapted to engage the detent abutment in such a manner that the spring-loaded detent lever urges one of the hinge bracket and mounting plate without backlash against a complementary stop of the other.

2. A hinge bracket-mounting plate assembly according to claim 1, wherein the distance between the engaging side face of the detent nose and the pivotal axis of the detent lever decreases continuously from that portion of said engaging side face which engages the edge or surface of the detent opening.

3. A hinge bracket-mounting plate assembly according to claim 1 or 2, wherein a clearance-adjusting screw is provided, which is in threaded engagement with the hinge bracket and has an annular groove, which is guided by the edges of a slot in the mounting plate, and said groove has side faces overlapping the edges of said slot.

4. A hinge bracket-mounting plate assembly according to claim 3, wherein the screw-guiding slot is open at one end.

5. A hinge bracket-mounting plate assembly according to claim 3, wherein the detent lever carries two detent noses disposed on opposite sides of the hinge bracket and the screw-guiding slot extends medially in the mounting plate and is open at its rear end.

6. A hinge bracket-mounting plate assembly according to claim 5, wherein the detent noses consist of teeth projecting outwardly from said detent lever, the latter is pivoted on a transverse pin, and the detent openings consist of slots formed in the web of the channel-shaped hinge bracket.

7. A hinge bracket-mounting plate assembly according to claim 1, wherein the track provided on the mounting plate consists of longitudinal grooves, which are provided on opposite sides of the mounting plate, and the hinge bracket is channel-shaped and has sliding lugs, which are angled inwardly from the ends of the legs of the bracket and adapted to enter said longitudinal grooves.

8. A hinge bracket-mounting plate assembly according to claim 7, wherein the complementary stops are constituted by the end faces of the grooves and by surfaces of the sliding lugs which face the groove end faces.

9. A hinge bracket-mounting plate assembly according to claim 7, wherein the sliding lugs are guided in the longitudinal grooves in a major part of the length thereof with a backlash, and the end portions of the longitudinal grooves are inclined to eliminate said backlash.

10. A hinge bracket-mounting plate assembly according to claim 1, wherein a compression spring which biases the detent lever is accommodated in an aperture of the mounting plate.

11. A hinge bracket-mounting plate assembly according to claim 1, wherein a locking lever having a hook-shaped opening is disposed in an opening of the mounting plate and is pivoted thereto and serves to releasably hold the detent lever in its retracted position and is provided with an outwardly protruding nose, which as the hinge bracket is pushed along the mounting plate is engaged by the hinge bracket and in response thereto turns said locking lever to a position in which the detent lever is released.

12. A hinge bracket-mounting plate assembly according to claim 11, wherein the locking lever extends through a slot formed in the detent lever.

13. A hinge bracket-mounting plate assembly according to claim 11 or 12, wherein a spring is provided, which urges the locking lever to a position for holding down the detent lever.

14. A hinge bracket-mounting plate assembly according to claim 11, wherein the hinge bracket includes a web having a stop, which cooperates with the nose of the locking lever.

15. A hinge bracket-mounting plate assembly according to claim 14, wherein the web of the hinge bracket is formed with an opening through which an implement for depressing the detent lever can be inserted.

16. A hinge bracket-mounting plate assembly according to claim 1, wherein two detent levers are pivoted on a transverse pin, which is secured in the mounting plate, and said detent levers are releasably locked in the hinge bracket.

17. A hinge bracket-mounting plate assembly according to claim 16, wherein the detent levers consist of two-armed levers and cooperate like pliers and the transverse pin is surrounded by a helical torsion spring, the opposite end portions of which bear on the detent levers to hold them in their expanded position, and the rear ends of the detent levers protrude from the mounting plate.

18. A hinge bracket-mounting plate assembly according to claim 1, wherein the detent lever is pivoted to the hinge bracket on a transverse pin and has projecting teeth, which constitute detent noses extending into detent openings of the mounting plate.

19. A hinge bracket-mounting plate assembly according to claim 18, wherein the hinge bracket is channel-shaped and carries stops which limit the angular movement of the detent lever.

20. A hinge bracket-mounting plate assembly according to claim 18 or 19, wherein the compression spring is held under initial stress between the detent lever and the web of the hinge bracket.

21. A hinge bracket-mounting plate assembly according to claim 18, wherein the mounting plate consists of two parts, one of which is a plate-like member, which is longitudinally adjustable relative to the other for an adjustment of the extent to which the hinge bracket can be pushed along the mounting plate.

22. A hinge bracket-mounting plate assembly according to claim 21, wherein the other part of the mounting plate includes a baseplate and the longitudinally adjustable plate-like element is formed with the detent opening and with a slot and is connected to the base plate by a screw extending through said slot, and an annular groove of a clearance-adjusting screw is guided by the edges of a screw-guiding slot formed in the longitudinally adjustable plate-like element.

23. A hinge bracket-mounting plate assembly according to claim 22, wherein the baseplate is formed with L-shaped guides and the longitudinally adjustable plate-like element has projections extending into said guides.

24. A hinge bracket-mounting plate assembly according to claim 1, the detent lever is pivoted to the mounting plate and the detent noses consist of two lugs, which are angled from the sides of said lever to form a channel-shaped portion and protrude into guiding grooves provided on the sides of the mounting plate, which lugs extend in said guiding grooves behind the rear edges of the sliding lugs which are carried by the hinge bracket so that said sliding lugs are locked between said detent lugs and the stops consisting of the end faces of the grooves.

25. A hinge bracket-mounting plate assembly according to claim 24, wherein the detent lever is a two-armed lever having one arm which carries the detent nose and another arm which constitutes a releasing key protruding from the hinge bracket.

26. A hinge bracket-mounting plate assembly according to claim 1, wherein the detent noses are provided at the ends of the legs of a U-shaped member and said legs are slidably mounted in tracks which are provided on the sides of the mounting plate and cross the longitudinal guiding grooves for the sliding lugs of the hinge bracket, a compression spring is held under initial stress between a web that connects the legs of the U-shaped member and the bottom of a blind bore in the mounting plate, and the detent noses extend outwardly into the longitudinal guiding grooves of the mounting plate and in their locking position extend behind the rear edges of the sliding lugs of the hinge bracket which are guided in said guiding grooves and are thus held between said detent elements and the stops constituted by the end faces of the grooves.

27. A hinge bracket-mounting plate assembly according to claim 26, wherein the hinge bracket is channel-shaped and its web is formed with an opening which registers with the web of the U-shaped member.

28. A hinge bracket-mounting plate assembly according to claim 1, wherein the detent lever is freely pivotally movable in the hinge bracket and has an angled portion which constitutes the detent nose and cooperates with a stop holding the lug in alignment with a guide sleeve of the mounting plate, a slider is slidably mounted in said guide sleeve and adapted to be depressed against spring force, the detent opening is formed in the wall of the guide sleeve, so that when the detent lever has been inserted into the guide sleeve the slider forces the angled portion against an edge of the detent opening so that the stops carried by the hinge bracket are forced against the complementary stops carried by the mounting plate.

29. A hinge bracket-mounting plate assembly according to claim 28, wherein the slider carries a rod, which extends through a hole in the end wall of the track sleeve and has a head protruding from the hinge bracket, and the rod is surrounded by a compression spring which is held under initial stress between the end wall and the slider.

30. A hinge bracket-mounting plate assembly according to claim 28 or 29, wherein the slider has a bevelled surface facing the angled portion of the detent lever.

31. A hinge bracket-mounting plate assembly according to claim 28, wherein the detent lever has a second lever arm, which extends from the pivot of the lever and which bears on the web of the channel-shaped hinge bracket so that the forward end portion of the detent lever is held in alignment with the guide sleeve of the mounting plate, said forward end portion comprising said angled portion.

32. A hinge bracket-mounting plate assembly according to claim 1, wherein one of the hinge bracket and the mounting plate includes secondary detent openings.

33. A hinge bracket-mounting plate assembly according to claim 1, wherein the detent lever has an actuating portion, which carries a removable locking member for locking the detent lever in its locking position.

34. A hinge bracket-mounting plate assembly according to claim 33, wherein the actuating portion is bifurcated and has sprongs for guiding said locking member, which has a beveled surface bearing on the rear edge of the hinge bracket.

35. A hinge bracket-mounting plate assembly according to claim 33, wherein the locking member has locking pegs held in openings of the hinge bracket and has a beveled surface bearing on the actuating portion.

36. A hinge bracket-mounting plate assembly according to claim 35, wherein said locking pegs are provided with hooks.

37. A hinge bracket-mounting plate assembly according to claim 33, wherein the locking member is slidably fitted between the detent lever and the hinge bracket.

* * * * *